US006600122B1

(12) United States Patent
Czarnecki et al.

(10) Patent No.: US 6,600,122 B1
(45) Date of Patent: Jul. 29, 2003

(54) CENTERING ARRANGEMENT FOR A MOVABLE CONTACT MEMBER IN A ROCKER-TYPE SWITCH

(75) Inventors: Neil A. Czarnecki, Mt. Pleasant, WI (US); Francis W. Camps, Kewaskum, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 10/206,032

(22) Filed: Jul. 26, 2002

Related U.S. Application Data

(63) Continuation-in-part of application No. 10/007,018, filed on Nov. 5, 2001.

(51) Int. Cl.[7] ..... H01H 21/00

(52) U.S. Cl. ..... 200/553; 200/339; 200/558; 200/559

(58) Field of Search ..... 200/6 R–6 C, 200/402, 405, 410, 416, 449, 450, 453, 553, 557–560, 339

(56) References Cited

U.S. PATENT DOCUMENTS

| | | | | |
|---|---|---|---|---|
| 2,782,279 A | | 2/1957 | Heusser | 200/68 |
| 3,225,156 A | | 12/1965 | Sahrbacker | 200/67 |
| 3,671,693 A | | 6/1972 | Farrell | 200/67 G |
| 4,168,416 A | | 9/1979 | Josemans | 200/323 |
| 4,203,017 A | * | 5/1980 | Lee | 200/437 |
| 4,242,551 A | * | 12/1980 | Sorenson | 200/302.3 |
| 4,689,450 A | * | 8/1987 | Sawada | 200/6 R |
| 4,789,766 A | | 12/1988 | Krause | 200/302.3 |
| 4,814,554 A | | 3/1989 | Magiera | 200/6 R |
| 5,053,591 A | * | 10/1991 | Theurer | 200/315 |
| 5,095,181 A | * | 3/1992 | Osika et al. | 200/43.16 |
| 5,105,059 A | | 4/1992 | Sorenson et al. | 200/302.3 |
| 5,735,392 A | * | 4/1998 | Shirasaka | 200/553 |
| 6,175,090 B1 | | 1/2001 | Blossfeld | 200/558 |
| 6,459,060 B1 | * | 10/2002 | Bartok | 200/553 |

* cited by examiner

*Primary Examiner*—Michael Friedhofer
(74) *Attorney, Agent, or Firm*—Boyle, Fredrickson, Newholm, Stein & Gratz, S.C.

(57) ABSTRACT

An electrical switch includes a housing within which a pair of spaced apart stationary contacts are located. A center contact is positioned between the pair of spaced apart stationary contacts. A movable contact member has a fulcrum section engaged with the center contact, and a pair of arms extending outwardly therefrom. Each arm carries a movable contact, and the movable contact is adapted for movement so as to selectively establish an electrical path between the center contact and one of the stationary contacts, by movement of the movable contact member about the fulcrum section. An actuator includes a spring biased plunger engaged with the movable contact member, for providing rocking movement of the movable contact member in response to movement of the actuator. The plunger includes a head portion which moves on the surfaces of the movable contact member for moving the movable contact member between ON and OFF positions. The movable contact member and the head portion of the plunger define a matching non-linear cross-sectional configuration, to positively locate the movable contact member in its OFF position, to provide consistent placement of the movable contacts relative to the stationary contacts.

15 Claims, 5 Drawing Sheets

CENTERING ARRANGEMENT FOR A MOVABLE CONTACT MEMBER IN A ROCKER-TYPE SWITCH

CROSS REFERENCE TO RELATED APPLICATIONS

This application is a continuation-in-part of application Ser. No. 10/007,018 filed Nov. 5, 2001.

BACKGROUND AND SUMMARY OF THE INVENTION

This invention relates to a rocker-type such as a single pole double throw switch, and more particularly to an improved construction for a contact carrier and an actuating plunger for use in such a switch.

A rocker-type switch, such as a single pole double throw (SPDT) switch, typically includes a housing within which first and second stationary contacts are mounted, and a stationary center contact is located between the stationary first and second contacts. In the prior art, the center contact has a channel shape. A V-shaped movable contact member or rocker is, formed of an electrically conductive material, is engaged with the channel-shaped center contact, and selectively connects the center contact to either the first stationary contact or the second stationary contact, in response to operation of an actuator movably mounted to the housing. Each leg of the V-shaped movable contact member carries a button-type contact that establishes contact with the underlying first or second stationary contact. The actuator is pivotably mounted to the housing, and includes an extendible and retractable plunger in engagement with the movable contact member. When the actuator is in an OFF position, the plunger is engaged within the trough or valley defined by the apex of the V-shaped contact member, which positions the V-shaped contact member such that the button-type contacts are out of contact with the first and second stationary contacts. Movement of the actuator to an ON position functions to move the plunger away from the trough or valley defined by the apex of the V-shaped contact member, along one of the legs of the V-shaped contact member to cause the movable contact member to rock or pivot on one of the walls of the channel-shaped stationary center contact. Such movement of the plunger functions to force the leg of the contact member downwardly, to bring the button-type contact into engagement with its associated underlying stationary contact. When the actuator is returned to its OFF position, the plunger is returned to the trough or valley defined by the apex of the V-shaped contact member, to rock or pivot the V-shaped contact member on the wall of the center contact and to raise the button-type contact out of engagement with its associated stationary contact. In the prior art, the distal end of the plunger is generally spherical in shape, which enables the plunger to move smoothly along the legs of the movable center contact member as the actuator is moved between its ON and OFF positions. However, the spherical shape of the plunger outer end does not match the geometry of the center contact member. This creates a problem when the actuator is in its OFF position, in that the "rest position", i.e. the position of the movable center contact member when the actuator is in its OFF position, is indeterminate. That is, the position of the movable center contact member can vary throughout a range of positions when the actuator is in its OFF position, due to the fact that the spherical end of the plunger has a configuration which does not match the configuration of the sharply angled apex defined by the legs of the center contact member. The resultant uncertainty in the position of the center member when the actuator is in its OFF position is undesirable in that the parting distance of the movable contact members from the stationary contact members is unknown and can vary widely from one actuation to another.

It is an object of the present invention to provide a plunger-actuated switch, such as a rocker-type switch or the like, with an actuator arrangement that ensures consistency of the movable contact member when the actuator is in its OFF position. It is a further object of the invention to provide such a switch which is of similar construction to prior art switches, and entails a relatively minor modification in the construction of the plunger so as to reliably and consistently position the movable contact member when the actuator is in its OFF position. A still further object of the invention is to provide such a switch in which the plunger is configured to take advantage of the existing construction of the movable contact member, to facilitate movement of the movable contact member and positioning of the movable contact member when the actuator is in its OFF position.

In accordance with the invention, an electrical switch generally includes a housing including a base defining an internal cavity, in combination with a cover engageable with the base and an actuator movably mounted to the cover. A stationary center contact is secured to a lower wall defined by the base, and spaced apart stationary first and second contacts are secured to the lower wall of the base on opposite sides of the stationary center contact. The switch further includes a movable contact member defining a central portion in engagement with the stationary center contact, and a pair of spaced apart end contact areas. A movable actuator is interconnected with the housing, and interacts with the movable contact member to selectively establish contact with either the first or second spaced apart stationary contacts. The actuator is movable between an OFF position, in which the movable contact member is maintained out of engagement with both the first and second contacts, and one of two ON positions. In a first ON position, the actuator is operable to move one of the contacts of the movable contact member into engagement with the first stationary contact, to establish an electrical path between the first stationary contact and the center stationary contact. In the second ON position, the actuator is operable to engage the second contact of the movable contact member with the second stationary contact, to establish an electrical path between the center contact and the second stationary contact.

The stationary center contact defines an upwardly facing substantially planar contact surface, and the stationary first and second contacts also define upwardly facing substantially planar contact surfaces. The movable contact member has a nonlinear configuration, and may be in the form of a V-shaped member having first and second arms extending outwardly from a common center or apex. Each of the first and second arms has a contact member secured toward its outer end. The actuator includes a spring biased plunger which interacts with the movable contact member so as to provide movement of the movable contact member between its first and second ON positions. The plunger includes an outer end that engages the movable contact member, and the spring bias of the plunger functions to bias the outer end of the plunger into engagement with the movable contact member.

The outer end of the plunger has a configuration that matches the configuration of the movable contact member. The plunger, actuator and movable contact member are configured such that the matching configuration of the movable contact member and the end of the plunger are in a complementary, mating relationship when the actuator and the movable contact member are in the OFF position. The end of the plunger defines a pair of surfaces which correspond to the V-shaped configuration of the movable contact member, which engage the surfaces of the movable contact member defining the trough or valley defined by the apex of the movable contact member when the actuator and movable contact member are in the OFF position. This matching configuration of the plunger and the contact member functions to positively maintain the movable contact member in a position in which the contacts of the movable contact member are at an equal elevation relative to the associated underlying stationary contact. The end of the plunger defines a tip between the side surfaces, which remains in engagement with the movable contact member as the actuator is moved between its ON and OFF positions, to impart rocking or pivoting movement to the movable contact member on the center contact in response to movement of the actuator. The side surfaces of the outer end of the plunger cooperate with the configuration of the movable contact member so as to provide a "self-righting" action as the actuator approaches its OFF position, to facilitate positioning of the actuator in its OFF position and to positively retain the movable contact member in a consistent and predictable OFF position, in which the contacts of the movable contact member are maintained at an equal and consistent elevation relative to the underlying stationary contact when the actuator and movable contact member are in the OFF position.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
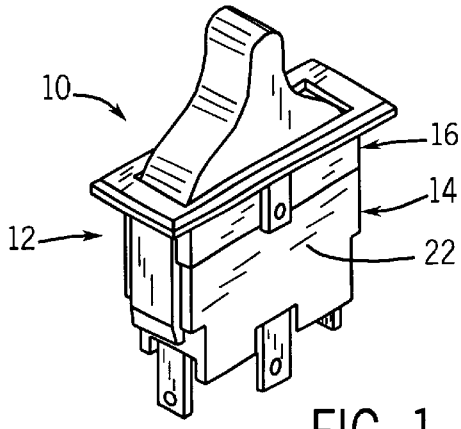
FIG. 1 is an isometric view of an electrical switch incorporating the features of the present invention.
Figure 2:
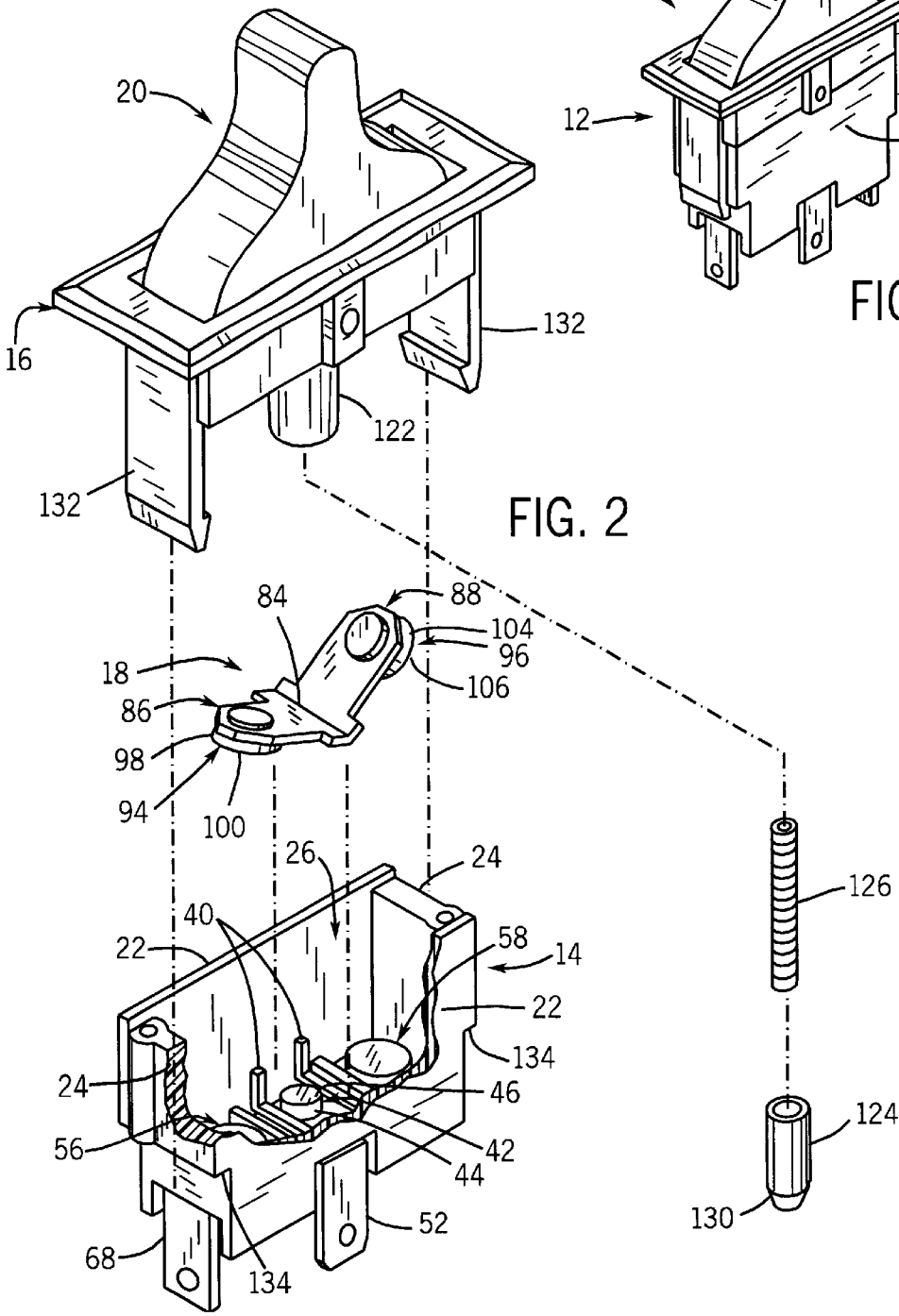
FIG. 2 is an exploded isometric view showing the components of the electrical switch of FIG. 1.
Figure 3:
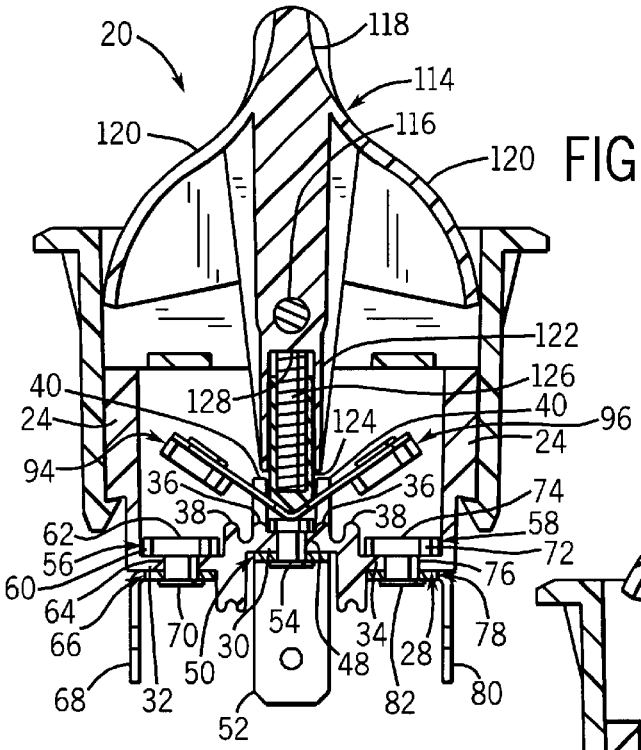
FIG. 3 is a section view through the electrical switch of FIG. 1, showing the movable contact member in an inoperative position.

Referring to FIGS. 1–3, an electrical switch 10 constructed according to the invention generally includes a housing assembly 12 made up of a housing base 14 and a cover 16, a movable contact member 18 and an actuator 20 movably mounted to cover 16.

Housing base 14 includes a pair of spaced apart side walls 22 and a pair of spaced apart end walls 24, which cooperate to define an internal cavity 26. Housing base 14 further includes a bottom wall 28 defining the lower extent of internal cavity 26. As shown in FIG. 3, bottom wall 28 includes a central section 30 in combination with a pair of spaced apart end sections 32, 34. End sections 32, 34 are substantially coplanar, and central section 30 is located above end sections 32, 34. Central section 30 includes a pair of spaced apart inner ribs 36, and an outer rib 38 is spaced outwardly of each inner rib 36. A pair of inwardly extending retaining ridges 40 are formed in each housing base side wall 22. Each retaining ridge 40 extends upwardly from an end of one of the inner ribs 36, such that the retaining ridges 40 on each housing base side wall 22 are spaced apart a distance equal to the spacing between inner ribs 36.

A center contact 42 is mounted to bottom wall central section 30 between inner ribs 36. Center contact 42 includes a contact head 44 defining an upwardly facing center contact surface 46. Center contact 42 is a rivet-type contact, including a shaft 48 that extends through an opening in bottom wall central section 30, and through an aligned opening in a central terminal strip 50 which includes a depending prong 52. A retainer head 54 is formed at the end of shaft 48 opposite contact head 44. In a known manner, retainer head 54 functions to secure both center contact 42 and terminal strip 50 in place on bottom wall 28, and to establish an electrical connection of center contact 42 with terminal strip 50. As illustrated, contact head 44 is located between inner ribs 36, and contact surface 46 of center contact 42 is spaced slightly above the upper extent of inner ribs 36 and outer ribs 38.

In a similar manner, stationary first and second contacts 56, 58 are mounted to housing base 14, and are located on opposite sides of center contact 42. Stationary first contact 56 includes a contact head 60 defining an upwardly facing first contact surface 62 and a shaft 64 that extends through an opening in bottom wall end section 32 and an aligned opening in a terminal strip 66 having a depending contact prong 68. A retainer head 70 is formed at the end of shaft 64 opposite contact head 60, for maintaining stationary first contact 56 and retainer strip 66 in engagement with end section 32 of bottom wall 28, and for establishing electrical contact between terminal strip 66 and stationary first contact 56. Contact head 60 of stationary first contact 56 has a diameter only slightly less than the space between the outer surface of outer rib 38 and the facing inner surface of housing base end wall 24. Upwardly facing contact surface 62 of stationary first contact 56 is located below the upper extent of the adjacent outer rib 38.

Stationary second contact 58 is constructed and arranged similarly to stationary first contact 56, including a contact head 72 defining an upwardly facing contact surface 74, a shaft 76 that extends through aligned openings in end section 34 of bottom wall 28 and in a terminal strip 78 having a depending contact prong 80. A retainer head 82 is formed at the end of shaft 76 opposite contact head 72, for securing stationary second contact 58 and terminal strip 78 to bottom wall 28, and for establishing electrical contact between stationary second contact 58 and terminal strip 78. Contact head 72 has a diameter slightly less than the space between the outer surface of outer rib 38 and the facing inner surface of housing base end wall 24. Upwardly facing contact surface 74 of stationary second contact 58 is located below the upper extent of the adjacent outer rib 38.

Figure 7:
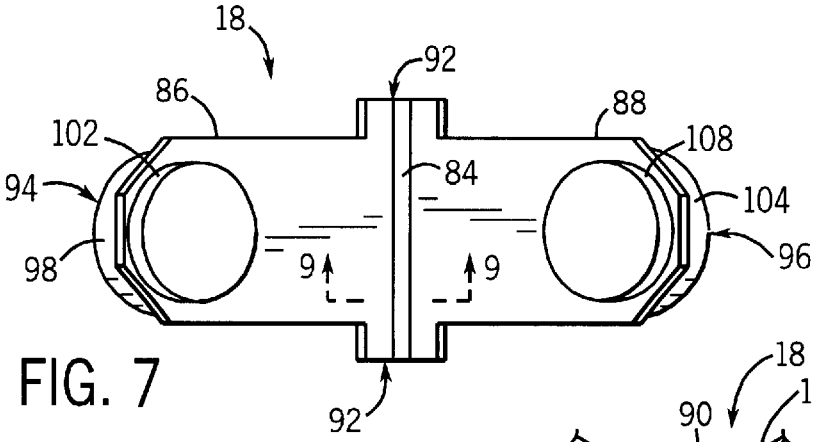
FIG. 7 is a plan view of the movable contact member incorporated into the switch of FIG. 1.

Referring to FIGS. 2, 3 and 7, movable contact member 18 defines a center contact area 84 and first and second contact arms 86, 88, respectively, extending outwardly from center contact area 84 in opposite directions. Movable contact member 18 is generally V-shaped, defining a vertex 90 at the intersection of first and second contact arms 86, 88, respectively. A pair of V-shaped retainer tabs 92 extend outwardly from opposite sides of movable contact member 18. Each retainer tab 92 has a V-shaped cross-section and is in the form of an outward extension of vertex 90 and an inner portion of each first and second contact arm 86, 88, respectively, extending outwardly from vertex 90.

A movable first contact 94 is secured toward the outer end of first contact arm 86, and a movable second contact 96 is mounted toward the outer end of second contact arm 88. Movable first contact 94 includes a contact head 98 defining a downwardly facing contact surface 100, and a retainer head 102 that secures movable first contact 94 to first contact arm 86 and establishes an electrical connection therebetween. Similarly, movable second contact 96 includes a contact head 104 defining a downwardly facing contact surface 106, and a retainer head 108 that secures movable second contact 96 to second contact arm 88 and establishes an electrical connection therebetween.

Figure 9:
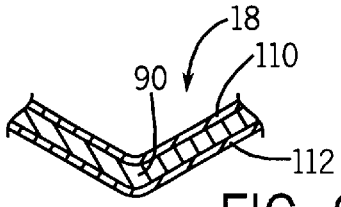
FIG. 9 is a partial section view along line 9—9 of FIG. 7.
Figure 8:
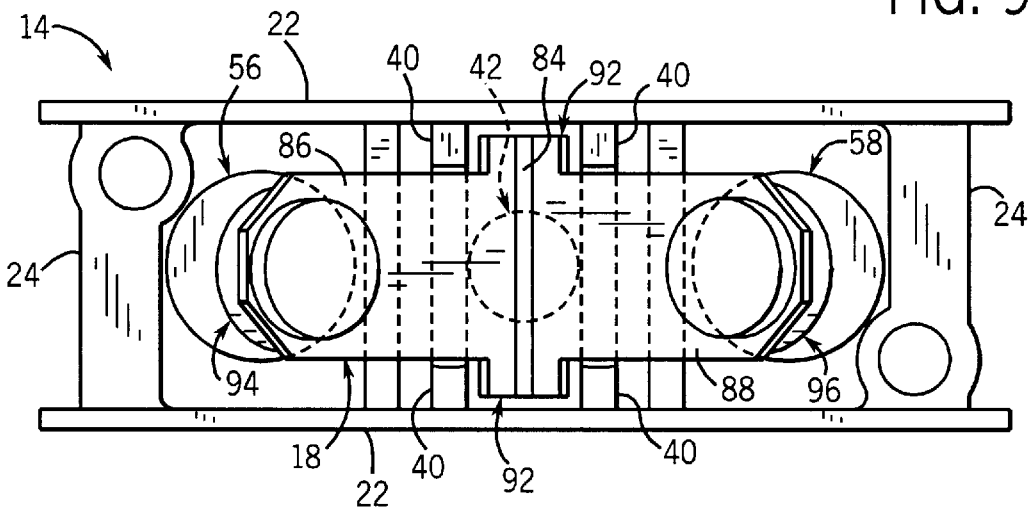
FIG. 8 is a plan view showing the movable contact member of FIG. 7 in position within the base portion of the switch housing, shown in FIG. 6.

Referring to FIG. 9, the upper surface of movable contact member 18 is coated with a conductive coating 110, and the lower surface of movable contact member 18 is coated with a conductive coating 112. Movable contact member 18 is typically formed of an electrically conductive material such as brass or copper, and conductive coatings 110, 112 may be in the form of any satisfactory type of conductive coating that serves to prevent oxidation of the underlying conductive material of movable contact member 18. Representatively, conductive coatings 110, 112 may be in the form of a plating of fine silver applied to all surfaces of movable contact member 18. Conductive coatings 110, 112 facilitate electrical contact between movable first and second contacts 94, 96 and respective first and second contact arms 86, 88. In addition, when movable contact member 18 is installed such that center contact area 84 engages center contact surface 46 of center contact 42, the area of lower conductive coating 112 that underlies vertex 90 and the adjacent areas of first and second contact arms 86, 88, respectively, forms the electrical contact of movable contact member 18 with contact surface 46.

Referring to FIGS. 1 and 3, actuator 20 includes an actuator member 114 pivotably mounted to and between a pair of spaced apart side walls defined by housing cover 16 by means of a pivot pin 116 extending therebetween. Actuator member 122 includes a manually engageable actuator tab 118 and a pair of wings 120 that extend downwardly and outwardly in opposite directions from actuator tab 118. Wings 120 function to enclose internal cavity 36 of housing base 24 when housing cover 16 and actuator 20 are engaged with housing base 24. Actuator member 114 further includes a barrel section 122 located inwardly of pivot pin 116. Barrel section 122 defines an internal passage within which a plunger member 124 is located. Plunger member 124 extends outwardly from the outer end of barrel section 122 and defines an internal passage within which a spring 126 is received. Spring 126 bears between the end of the plunger passage and the end of the barrel passage, shown at 128, for biasing plunger member 124 outwardly relative to barrel section 122. At its outer end, plunger member 124 defines a conical tip 130 having angled side walls that match the angle between first and second contact arms 84, 86, respectively.

In a known manner, housing cover 16 includes a pair of fingers 132 configured to engage detent surfaces 134 formed on housing base end walls 24, for securing housing cover 16 and actuator 20 to housing base 14.

In operation, electrical switch 10 can be connected in a circuit in which a power source is interconnected with center contact 42 and an electrical load is connected to each of first and second contacts 56, 58, respectively. Alternatively, electrical switch 10 may be employed as a transfer switch, in which a pair of separate power sources are connected to each of stationary first and second contacts 56, 58, respectively, and a single electrical load is interconnected with center contact 42. Actuator 20 is movable relative to housing 12 so as to move movable contact member 18 between an inoperative position as shown in FIG. 3, a first operative position as shown in FIG. 4 and a second operative position as shown in FIG. 5.

When movable contact member 18 is in the inoperative position of FIG. 3, actuator member 114 is positioned such that barrel section 122 extends coaxially with a longitudinal axis defined by housing base 14, which is coincident with the longitudinal axis of center contact shaft 48. Plunger member 124 thus applies a downward force on center contact area 84 of movable contact member 18. The mating engagement of conical tip 138 of plunger member 124 with the central upper surfaces of center contact area 84 functions to maintain movable contact member 18 in its inoperative position, in which both movable first contact 94 and movable second contact 96 are maintained out of contact with respective stationary first and second contacts 56, 58.

Figure 4:
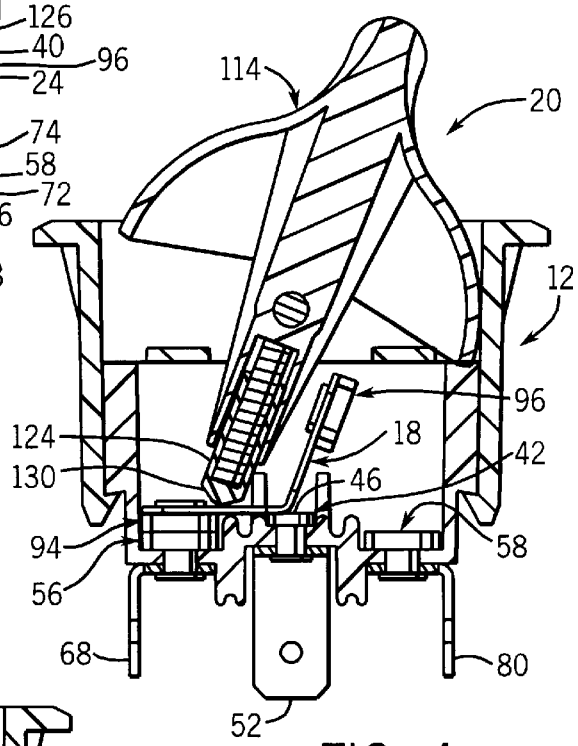
FIG. 4 is a view similar to FIG. 3, showing the movable contact member in a first operative position.
Figure 5:
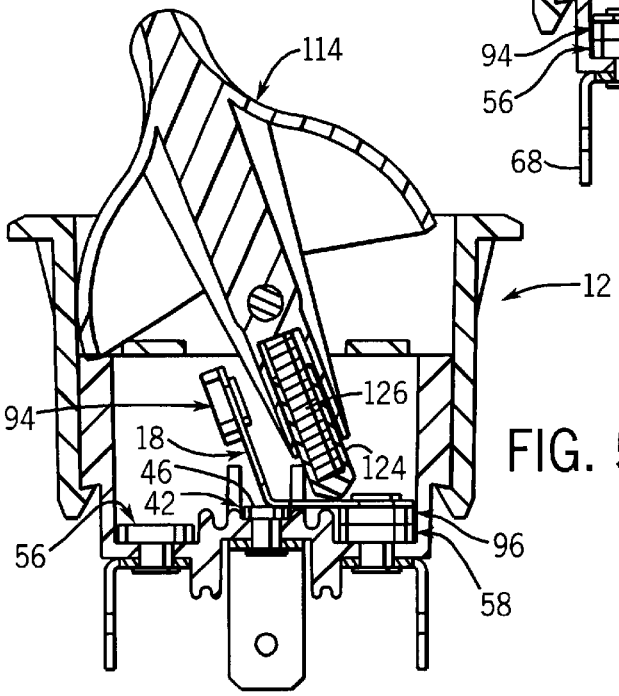
FIG. 5 is a view similar to FIGS. 3 and 4, showing the movable contact member in a second operative position.
Figure 6:
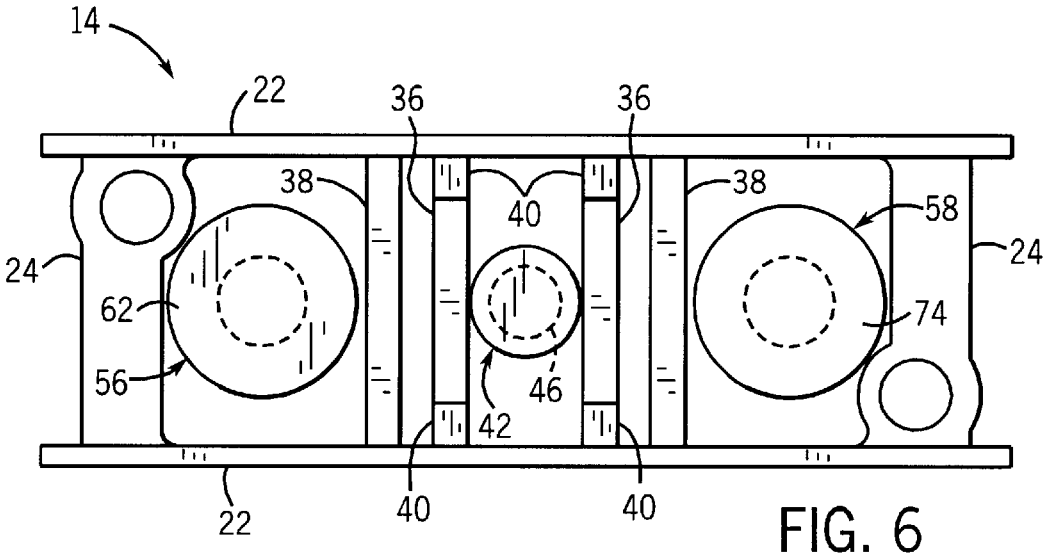
FIG. 6 is a plan view of a base portion of the housing of the switch of FIG. 1, showing the stationary center contact and the spaced apart stationary first and second contacts.

To place movable contact member 18 in its first operative position of FIG. 4, actuator member 114 is pivoted in a clockwise direction about pivot pin 116 by application of a manual force to actuator tab 118. This causes barrel section 122 to move away from center contact area 84 of movable contact member 18, and along the upper surface of first contact arm 86. The outward bias applied to plunger member 124 by spring 126 applies a downward force on first contact arm 86, such that movable first contact 94 is moved downwardly into engagement with contact head 60 of stationary first contact 56. During such movement, vertex 90 of movable contact member 18 acts as a fulcrum about which movable contact member 18 is moved, maintaining engagement of vertex 90 with contact surface 46 of center contact head 44.

The thickness of contact head 98 of movable first contact 94 is equivalent to the difference in elevation between contact surface 46 of center contact head 44 and contact surface 62 of first contact head 60. In this manner, first contact arm 86 of movable contact member 18 extends transversely relative to the longitudinal axis of housing base 14, and parallel to center contact surface 46 of center contact head 44, when movable contact member 18 is in its first operative position of FIG. 4. This arrangement functions to create contact between center contact surface 46 and the inner portion of center contact area 84 adjacent vertex 90 when movable contact member 18 is in its first operative position, to maximize the area of contact between stationary center contact 42 and first contact arm 86. Further, the conductive coating 112 on the outer surface of movable contact member 18 also enhances the conductive contact between stationary center contact 42 and movable contact member 18, which otherwise may form a nonconductive oxidized coating over time.

The downward component of the force applied to first contact arm 86 by plunger member 124 and spring 126 results in a downward force of center contact area 84 on center contact surface 46, as well as a downward force that engages contact surface 100 of movable first contact 94 with upwardly facing contact surface 62 of stationary first contact 56.

In order to connect stationary center contact 42 with stationary second contact 58, actuator member 114 is pivoted in a counterclockwise direction about pivot pin 116, to first place movable contact member 18 in its inoperative position of FIG. 3. Continued counterclockwise pivoting movement of actuator member 114 causes conical tip 130 of plunger member 124 to slide along the inner surface of second contact arm 88, to rock movable contact member 18 to its second operative position of FIG. 5. Again, vertex 90 of movable contact member 18 acts as a fulcrum to provide such movement of movable contact member 18 to its second operative position, to maintain movable contact member 18 in constant contact with contact surface 46 of center contact head 44. When movable contact member 18 is placed in its second operative position of FIG. 5, second contact arm 88 is positioned similarly to first contact arm 86 when movable contact member 18 is in its first operative position of FIG. 4. That is, second contact arm 88 extends parallel to the plane of center contact surface 46, to provide contact between center contact surface 46 and the inner area of second contact arm 88 adjacent vertex 90. Again, plunger member 124 applies downward forces on movable second contact 96 into engagement with stationary second contact 58, which also are applied to the inner portion of second contact arm 88 adjacent vertex 90.

The horizontal position of each of first and second contact arms 86, 88, respectively, when movable contact member 18 is in the first and second operative positions, respectively, provides maximum contact area between movable contact member 18 and stationary center contact 42. The downward biasing force applied by plunger member 124 ensures constant contact of center contact area 84 of movable contact member 18 with center contact surface 46 at all times, including when movable contact member 18 is in either its first or second operative positions. The conductive coating applied to movable contact member 18 provides good electrical contact and prevents oxidization.

The location of retainer tabs 92 of movable contact member 18 between retaining ridges 40 of housing base 14 functions to maintain the position of movable contact member 18 relative to housing base 14 during movement of movable contact member 18. In this manner, movable contact member 18 is allowed to pivot on the flat center contact surface 46 of stationary center contact 42 in a manner such that center contact area 84 of movable contact member 18 acts as a fulcrum, to ensure constant, high quality contact of center contact area 84 with center contact surface 46.

Figure 11:
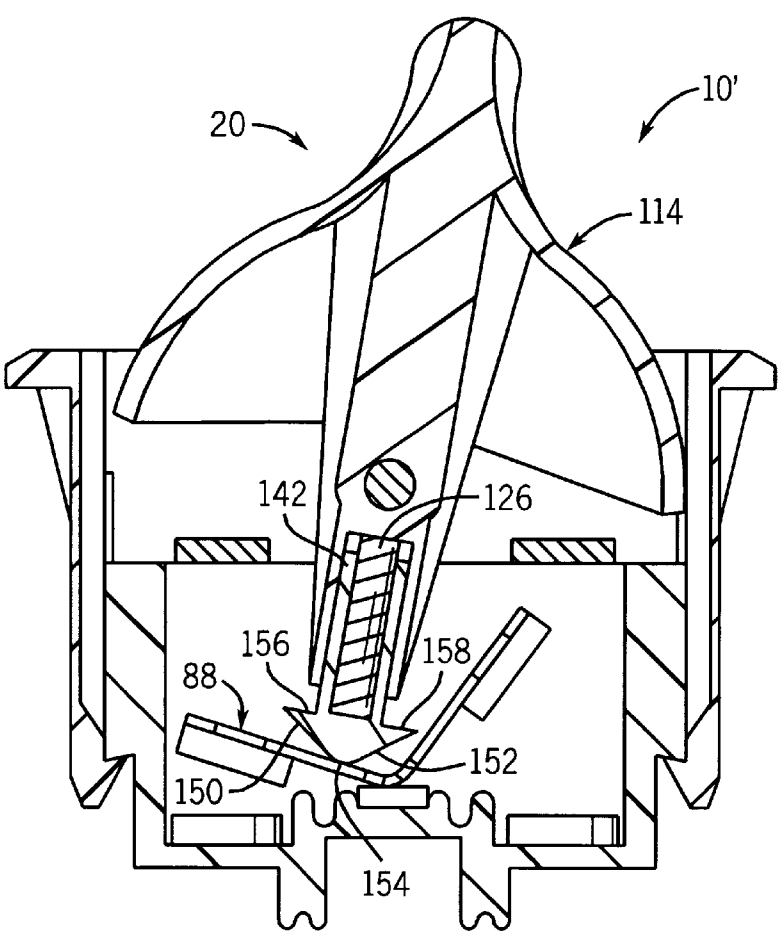
FIG. 11 is a view similar to FIG. 10, showing initial movement of the actuator away from its OFF position, so as to move one of the contacts of the movable contact member toward its associated underlying stationary contact.
Figure 10:
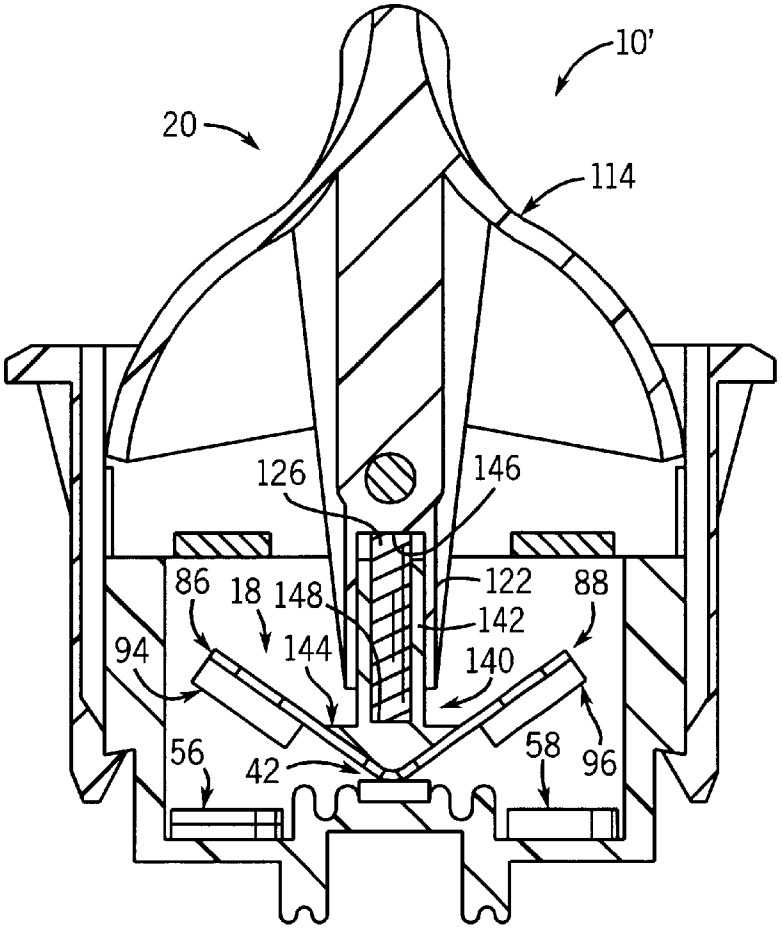
FIG. 10 is a section view similar to FIG. 3, showing a centering arrangement between the actuator and the movable contact member, in accordance with another aspect of the present invention, in which the actuator is in an OFF position.
Figure 12:
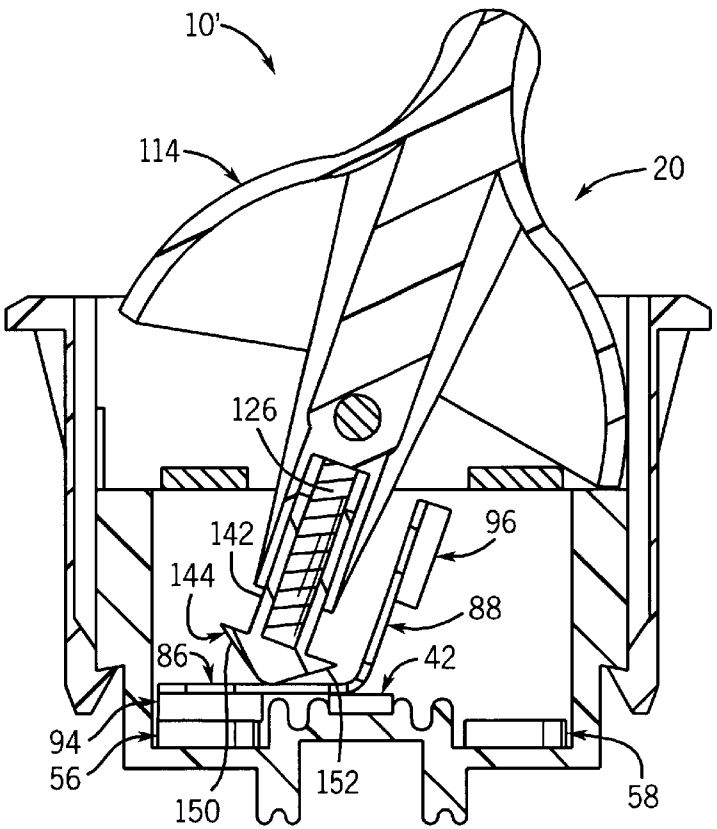
FIG. 12 is a view similar to FIGS. 10 and 11, showing the actuator in its ON position and engagement of the contact with its associated underlying stationary contact.

FIGS. 10–12 illustrate an electrical switch 10' having a majority of components which are the same as those incorporated in electrical switch 10, and like reference characters will be used where possible to facilitate clarity.

Figure 13:
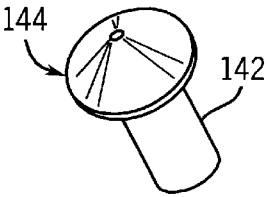
FIG. 13 is an isometric view of a plunger forming a part of the centering arrangement of FIGS. 10–12.

Actuator 20 of electrical switch 10' includes a plunger member 140 engaged with barrel section 122 of actuator member 114. Plunger member 140 includes a tubular sleeve 142 that extends into barrel section 122, and a head 144 at the outer end of sleeve 142. As shown in FIG. 13, head 144 of plunger member 140 has a generally conical configuration.

Referring again to FIGS. 10–12, spring 126 is received within the passage defined by sleeve 142, and bears between an end wall 146 defined by barrel portion 122, and an end wall 148 at the inner end of the passage defined by sleeve 142.

The tapered surface of head 144 of plunger 140 is configured so as to match the configuration of movable contact member 18. That is, head 144 defines divergent side surfaces 150, 152, which define the same included angle as arms 86, 88 of movable contact member 18. A slightly rounded tip 154 is defined at the intersection of side surfaces 150, 152 of plunger head 144. Side surfaces 150, 152 extend outwardly in opposite directions beyond the sides of sleeve 142. Representatively, sleeve 142 has an outside diameter of 0.145 inches, and head 144 is configured such that each side surface 150 extends outwardly from its respective side of sleeve 142 a distance of approximately 0.0775 inches. Head 144 defines inner surfaces 156, 158 which extend outwardly from the sides of sleeve 142 and which intersect respective side surfaces 150, 152. With this construction, head 144 defines a generally triangular cross-section, with tip 154 being slightly rounded so as to conform to the slightly rounded intersection of arms 86, 88 of movable contact member 18. The rounded configuration of head 144 provides line contact with the inside surfaces of arms 86,88.

In operation, as shown in FIG. 10, spring 126 urges plunger head 144 outwardly against the inner surfaces of legs 86, 88 of movable contact member 18 when actuator 20 is in its OFF position, to place movable contact member 18 in its OFF position as shown. In this position, plunger 140 is urged outwardly toward the apex or vertex of movable contact member 118. Tip 154 of plunger head 144 is received within the trough or valley defined at the intersection of arms 86, 88 of movable contact member 18, and side surfaces 150, 152 of head 144 engage and apply pressure to the lower areas of arms 86, 88 of movable contact member 18. In this manner, the complementary, matching configuration of head 144 and movable contact member 18 function to positively place movable contact member 18 in its OFF position, in which contacts 94, 96 are elevated an equal amount relative to their associated respective underlying stationary contacts 56, 58.

When it is desired to operate switch 10' so as to move movable contact member 18 toward one of its ON positions, e.g. to engage movable contact 94 with stationary contact 56, actuator 20 is pivoted in a clockwise direction about pivot pin 116, as shown in FIG. 11. Such movement of actuator 20 dislodges tip 154 of plunger head 144 from the trough or valley of movable contact member 18, and moves tip 154 along arm 86 of movable contact member 18. The outward bias applied by spring 126 functions to maintain tip 154 of head 144 in engagement with the inner surface of arm 86, to apply downward pressure on arm 86 so as to cause movable contact member 18 to rock on center contact 42 in a counterclockwise direction. Continued movement of actuator 20 toward its ON position, as shown in FIG. 12, causes continued outward movement of plunger 140 relative to barrel section 122, and continued application of downward pressure on movable contact arm 86. In this manner, contact 94 is moved into engagement with underlying stationary contact 56, to establish an electrical path between center contact 42 and stationary contact 56.

When it is desired to break the connection between center contact 42 and stationary contact 56, the user operates actuator 20 in a reverse manner, so as to pivot actuator 20 from its ON position of FIG. 12 toward its OFF position of FIG. 10. During such movement of actuator 20, tip 154 of plunger head 144 moves inwardly along arm 86 of movable contact member 18 toward the trough defined by movable contact member 18. As such movement of plunger head 144 continues in this manner, the side of plunger head 144, defined at the intersection of side surface 154 with inner surface 158, comes into contact with the inner surface of arm 88 of movable contact member 18. This causes downward movement of arm 88, and thereby clockwise rocking movement of movable contact member 18 on center contact 42, to raise movable contact 94 out of engagement with stationary contact 56. Spring 126 continues to apply downward pressure on plunger 140, which tends to force plunger head 144 toward the trough defined between arms 86 and 88 of movable contact member 18. In this manner, the configuration of plunger head 144 provides a "self-centering" feature, once contact with arm 88 of movable contact member 18 is established as actuator 20 is moved toward its OFF position. Thereafter, the bias of spring 126 is operable to urge head 144 into the trough of movable contact member 18, which is operable to urge actuator 20 toward its upright OFF position and to urge movable contact member 18 toward its raised, centered OFF position. Once actuator 20 and movable contact member 18 reach the OFF position as shown in FIG. 10, the engagement of side surfaces 150, 152 of plunger head 144 with the inner areas of arms 86, 88, respectively, of movable contact member 18 function to maintain movable contact member 18 in its centered off position, as shown in FIG. 10. As can be appreciated, actuator 20 and movable contact member 18 can be moved in the opposite direction so as to establish contact between movable contact 96 and stationary contact 58, in the same manner as described above.

The matching geometry of plunger head 144 and movable contact member 18 function to ensure that, whenever actuator 20 is in its OFF position, movable contact member 18 is in a centered OFF position so as to maintain a maximum degree of separation between movable contacts 94, 96 and respective stationary contacts 56, 58. In addition, the configuration of head 144 assists in initial acceleration of movable contact member 18 toward its ON position in response to initial movement of actuator 20 away from its OFF position, to reduce "teasing" and improving circuit breaking performance of the switch. Further, the matching configuration of head 144 and movable contact member 18 as shown and described tolerates an angular error on actuator handle 114 up to approximately 10 degrees from the center OFF position without reducing the parted distance of the contacts, to prevent inadvertent actuation of switch 10.

Figure 14:
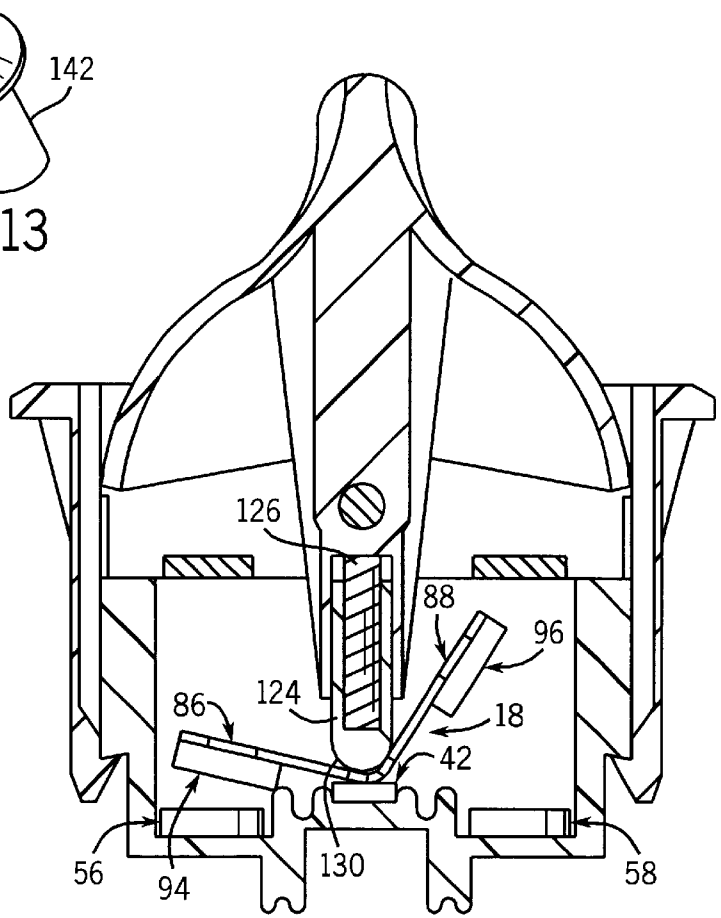
FIG. 14 (PRIOR ART)
FIG. 14 is a view similar to FIGS. 10–12, showing the movable contact member and a prior art configuration of an actuator for imparting movement to the movable contact member.

FIG. 14 illustrates a prior art construction, in which the end of plunger member 124 is spherical in shape. The unmatched configuration of the end of plunger 126 and the inner surfaces of movable contact member 18 result in the possibility that movable contact member 18 may be in a non-centered orientation when actuator 20 is in its OFF position, as shown, which can result in an undesirable condition within switch 10.

While the configuration of plunger head 144 and the various surfaces of movable contact member 18 have been shown and described with respect to a specific embodiment, it is understood that variations and alternatives are possible and are contemplated as being within the scope of the present invention. For example, tip 154 of plunger head 144 may be flattened or formed with a concave configuration so as not to positively be received within the trough defined by movable contact member arms 86, 88. In a configuration such as this, the outer areas of side surfaces 150, 152 function as described previously to center movable contact member 18. While plunger head 144 is illustrated as having a conical configuration, it is also understood that plunger head 144 may be elongated in a transverse direction, akin to the configuration of the roof of a house. Further, while head 144 is shown as having a width greater than the diameter of sleeve 142, it is also understood that head 144 may have a transverse dimension the same as or less than that of sleeve 142. In addition, while plunger head 144 and movable contact member are shown and described as having a complementary divergent configuration, it is understood that other complementary shapes of plunger head 144 and movable contact member 18 may be employed, e.g. a matching rounded configuration, a matching concave configuration, or a matching convex configuration. Further, while the centering feature of the invention has been shown and described in connection with a rocker type switch, it is understood that the centering feature may be employed in other types of switches, e.g. paddle switches, toggle switches, etc.

Various alternatives and embodiments are contemplated as being within the scope of the following claims particularly pointing out and distinctly claiming the subject matter regarded as the invention.

We claim:

1. An electrical switch, comprising:

a housing including at least a pair of spaced apart stationary contacts;

a movable contact member having a non-linear configuration, wherein the movable contact member includes a fulcrum section in engagement with a first one of the stationary contacts, and a movable contact section spaced outwardly from the fulcrum section, wherein the movable contact member is movable between an ON position in which the movable contact section is engaged with a second one of the stationary contacts, and an OFF position in which the movable contact section is moved out of engagement with the second stationary contact; and a pivotable actuator arrangement interconnected with the housing and operable to move the movable contact member between the ON and OFF positions, wherein the actuator arrangement includes a biased operating member having an outer portion in engagement with the movable contact member, wherein the outer portion of the biased operating member defines a non-linear configuration complementary to the non-linear configuration of the movable contact member, wherein the bias of the operating member in combination with the complementary non-linear configuration of the outer portion of the operating member and the movable contact member function to place the movable contact member in the OFF position out of engagement with the second stationary contact.

2. The electrical switch of claim 1, wherein the fulcrum section of the movable contact member is defined by a pair of contact arms that extend outwardly in a non-linear relationship from the fulcrum section.

3. The electrical switch of claim 2, wherein the outer portion of the biased operating member defines a pair of angled divergent surfaces having an angle that matches the angle defined by the pair of contact arms, wherein the angled divergent surfaces engage the contact arms when the movable contact member is in the OFF position.

4. The electrical switch of claim 3, wherein the housing includes a center contact with which the fulcrum section of the movable contact member is engaged, and a pair of movable contacts, each of which is mounted to one of the pair of contact arms.

5. The electrical switch of claim 1, wherein the biased operating member includes a sleeve section received within a passage associated with a switch member forming a part of the actuator arrangement, and wherein the outer portion of the biased operating member comprises a head section located outwardly of the sleeve section, wherein the non-linear configuration of the biased operating member is defined by the head section.

6. The electrical switch of claim 5, wherein the head section of the biased operating member defines a tip in engagement with the movable contact member, wherein movement of the tip relative to the movable contact member functions to move the movable contact member between the ON and OFF positions.

7. The electrical switch of claim 6, wherein the head section of the biased operating member further defines a side edge spaced laterally from the tip and wherein, as the actuator is pivoted so as to move the movable contact member toward the OFF position, the tip engages the movable contact member on one side of the fulcrum section and the contact edge engages the movable contact member on the other side of the fulcrum section, to facilitate movement of the movable contact member toward the OFF position.

8. An electrical switch, comprising:

a pair of stationary contacts;

a center contact located between the pair of stationary contacts;

a movable contact member having a fulcrum section engaged with the center contact; and an actuator engaged with the movable contact member, wherein the actuator includes an extendible and retractable operating member in engagement with the movable contact member, wherein the actuator is movable so as to cause movement of the operating member on the movable contact member to selectively engage one or the other of the pair of arms of the movable contact member with one of the pair of stationary contacts;

wherein the movable contact member defines a pair of divergent surfaces extending from the fulcrum section and wherein the operating member includes a pair of divergent surfaces configured to match the divergent surfaces of the movable contact member wherein, when the actuator is in an OFF position, the operating member is positioned so as to engage the divergent surfaces of the operating member with the divergent surfaces of the movable contact member so as to place the pair of arms in a predetermined orientation relative to the pair of stationary contacts.

9. The electrical switch of claim 8, wherein the movable contact member includes a pair of arms that extend from the fulcrum section, wherein the divergent surfaces are defined by the pair of arms.

10. The electrical switch of claim 9, wherein the actuator is pivotably mounted to a housing within which the pair of stationary contacts and the center contact are contained, and wherein the extendible and retractable operating member of the actuator includes a biasing arrangement for urging the operating member into engagement with the movable contact member.

11. The electrical switch of claim 10, wherein the divergent surfaces of the operating member extend from a tip defined by the operating member which is in engagement with the movable contact member so as to apply pressure to the movable contact member upon movement of the actuator and to move the movable contact member between the ON and OFF positions.

12. The electrical switch of claim 11, wherein the divergent surfaces of the operating member include a pair of laterally spaced side contact edges, each of which is configured and arranged to engage one of the arms of the movable contact member upon movement of the actuator toward the OFF position so as to impart rocking motion to the movable contact member about the fulcrum section and to thereby facilitate movement of the movable contact member toward the OFF position.

13. In an electrical switch including a movable contact member having a pair of divergent engagement surfaces and a pair of spaced apart movable contacts, wherein the movable contact member is in engagement with a stationary center contact and wherein each of the movable contacts is movable into engagement with one of a pair of stationary contacts located on either side of the center contact, the improvement comprising a spring biased actuator having an outer operating section that engages the movable contact member, wherein the outer operating section defines a non-linear cross-section which matches a cross-section defined by the movable contact member, wherein the operating member and the movable contact member are positioned so that the operating member is in a complementary relationship relative to the movable contact member when the actuator and the movable contact member are in an OFF position, and wherein movement of the actuator away from the OFF position functions to move the actuator along a surface defined by the contact member so as to move one of the movable contacts into engagement with one of the stationary contacts.

14. The improvement of claim 13, wherein the movable contact member and the operating member of the actuator have a complementary V-shaped cross-section.

15. The improvement of claim 14, wherein the operating member includes a pair of outwardly spaced side contact edges, and wherein the operating member defines divergent surfaces extending between a tip area and the outwardly spaced side contact edges which are engageable with inner areas defined by the movable contact member when the actuator and the movable contact member are in the OFF position.

* * * * *